US006514682B1

(12) United States Patent
Eikenberry

(10) Patent No.: US 6,514,682 B1
(45) Date of Patent: Feb. 4, 2003

(54) SPEED ADDENDUM FOR PHOTOGRAPHIC EMULSIONS

(75) Inventor: Jon N. Eikenberry, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/885,751

(22) Filed: Jun. 20, 2001

(51) Int. Cl.[7] ..... G03C 1/035; G03C 1/015; G03C 1/09; G03C 1/10

(52) U.S. Cl. ..... 430/569; 430/567; 430/599; 430/603

(58) Field of Search ..... 430/567, 569, 430/599, 603

(56) References Cited

U.S. PATENT DOCUMENTS

| | | | | |
|---|---|---|---|---|
| 2,419,975 | A | 5/1947 | Trivelli et al. | |
| 2,875,058 | A | 2/1959 | Carroll et al. | |
| 2,937,089 | A | 5/1960 | Jones et al. | |
| 3,457,078 | A | 7/1969 | Reister | |
| 3,458,318 | A | 7/1969 | Brooks | |
| 3,615,632 | A | 10/1971 | Shiba et al. | |
| 3,695,888 | A | 10/1972 | Hiller et al. | |
| 3,706,567 | A | 12/1972 | Hiller | |
| 3,801,330 | A | 4/1974 | Brinckman et al. | |
| 4,128,428 | A | 12/1978 | Ikenoue et al. | |
| 4,378,426 | A | 3/1983 | Lok et al. | 430/600 |
| 4,451,557 | A | 5/1984 | Lok et al. | 430/600 |
| 4,971,890 | A | 11/1990 | Okada et al. | 430/603 |
| 5,166,044 | A | 11/1992 | Asami | |
| 5,192,654 | A | 3/1993 | Hioki et al. | 430/600 |
| 5,306,612 | A | 4/1994 | Philip, Jr. et al. | 430/576 |
| 5,459,052 | A | 10/1995 | Skriver et al. | 530/303 |
| 5,500,333 | A | 3/1996 | Eikenberry et al. | 430/600 |
| 5,747,235 | A | 5/1998 | Farid et al. | 430/599 |
| 5,747,236 | A | 5/1998 | Farid et al. | 430/599 |
| 5,763,151 | A | 6/1998 | Brust et al. | |
| 6,010,841 | A | 1/2000 | Farid et al. | 430/599 |
| 6,277,549 | B1 * | 8/2001 | De Keyzer et al. | 430/599 |

FOREIGN PATENT DOCUMENTS

| | | |
|---|---|---|
| EP | 0 554 856 | 2/1993 |
| EP | 0 922 994 | 6/1999 |

OTHER PUBLICATIONS

Belloni J et al., "Enhanced Yield of Photoinduced Electrons In Doped Silver Halide Crystals", LETTERS TO NATURE, Dec. 23–30, 1999, MacMillan Magazines, UK, vol. 402, no. 6764, pp. 865–967.

"Chemical Image Problem Has Sensitive Solution", CHEMISTRY AND INDUSTRY, CHEMISTRY AND INDUSTRY REVIEW, CHEMICAL SOCIETY. LETCHWORTH, GB, no. 1, Jan. 10, 2000 (Feb. 10, 2000), page 5, XP–000902486.

Japanese Patent Abstract 2027327 A, Jan. 1990, Konica Corp.

* cited by examiner

*Primary Examiner*—Richard L. Schilling
(74) *Attorney, Agent, or Firm*—Paul A. Leipold; Lynne M. Blank

(57) ABSTRACT

The invention relates to an emulsion comprising chemically and spectrally sensitized silver halide grains having formate on the surface of said grams.

17 Claims, No Drawings

SPEED ADDENDUM FOR PHOTOGRAPHIC EMULSIONS

FIELD OF THE INVENTION

This invention relates to photographic elements. It particularly relates to an improved silver halide obtained by surface treatment with formate.

BACKGROUND OF THE INVENTION

The photographic industry is constantly experimenting with methods of increasing film speed and at the same time reducing granularity. The most direct approach to increasing photographic speed in a silver halide based system is to increase the light sensitivity of the silver halide grains by making the grains larger. However, such an approach leads directly to increased granularity which the customer can find objectionable. If, on the other hand, the inherent photoefficiency of the emulsion grains can be increased without changing grain size, greater speeds can be obtained without added granularity.

Another important aspect of utilizing an addendum to alter emulsion speed is the point of addition. If the emulsion can be treated after it is prepared and fully sensitized, the building of a particular color record in a film is greatly simplified. Photographic film contains many chemical elements that can interact in unpredictable ways making film building very much an empirical or "trial and error" process. It is often impossible to predict the exact photographic speed required of a given emulsion. Rather, the emulsion must first be manufactured and placed in the complex milieu of the multi-layered photographic film to determine its effect. For instance, in the development of a new film much effort is expended in obtaining a linear response to light over a wide exposure latitude. Under these conditions it is critical to be able to obtain an emulsion with exactly the right photographic speed to combine with either a slower or faster emulsion or both and extend the exposure range. This process is called "knitting the curve" and relates to the shape of the curve obtained when optical density is plotted versus the log of the exposure for the color record of interest. The aim here is to produce a linear transition between the effective ranges of the individual emulsions and thereby provide consist tone reproduction. If one is able to alter the speed of an emulsion without remaking or resensitizing it, the cost of developing a new film is greatly reduced.

Many materials have been examined for their ability to increase photoefficiency. Notable examples are thioureas (U.S. Pat. No. 3,458,318), sulfonic acid derivatives (U.S. Pat. Nos. 2,937,089 and 3,706,567), triazine compounds (U.S. Pat. Nos. 2,875,058 and 3,695,888), mercapto compounds (U.S. Pat. No. 3,457,078), pyrmidine derivatives (U.S. Pat. No. 3,615,632), dihyrodpyridine compounds (U.S. Pat. No. 5,192,654), aminotriazoles (U.S. Pat. No. 5,306,612), hydrazines (U.S. Pat. Nos. 2,419,975, 5,459,052 and 4,971,890 and EP Application No. 554,856 A1, propargyl and butynyl benzoxazoles (U.S. Pat. Nos. 4,378,426, 4,451,557, and 5,500,333), fragmentable electron donors (U.S. Pat. Nos. 5,747,235, 5,747,236, and 6,010,841), and organic hole-trapping dopants (EP Application 0922994 A2). Disadvantages in the use of these compounds include relatively small speed effects, fog increases, loss in emulsion stability, exorbitant cost, the need to treat the emulsion either during making or during sensitizing, and undesirable interactions resulting from the relatively complex chemical structure of the addendum.

PROBLEM TO BE SOLVED BY THE INVENTION

Thus, there continues to be a need for more photoefficient emulsions that can be obtained utilizing an inexpensive, readily available, chemically simple addendum. The addendum should produce substantial speed gains with minimal fog effects and few undesirable interactions. Further benefits can be realized if the emulsion can be treated after it is fully prepared and spectrally sensitized.

SUMMARY OF THE INVENTION

It is an object of the invention to provide more photoefficient emulsions through the use of an inexpensive, readily available, chemically simple addendum.

It is another object to provide an addendum that has few undesirable side effects such as increased fog or poorer keeping properties of the emulsion.

It is a further object to provide an addendum that can be utilized with a fully prepared and spectrally sensitized emulsion.

These and other objects of the invention are accomplished by an emulsion comprising chemically and spectrally sensitized silver halide grains having formate on the surface of said grains.

ADVANTAGEOUS EFFECT OF THE INVENTION

The invention provides a means of obtaining silver halide emulsions with increased photoefficiency. This is accomplished through the use of an addendum that is inexpensive, readily available, and chemically simple. The addendum can be used after the emulsion is made and spectrally sensitized thereby simplifying and reducing the cost of producing a new film. The increased photoefficiency of the emulsion is accompanied by minimal side effects such as increased fog or degraded keeping.

DETAILED DESCRIPTION OF THE INVENTION

The invention has numerous advantages over prior methods of preparing photographic emulsions. The invention provides emulsions with increased photoefficiency that can be used to manufacture photographic film having greater photographic speed and/or improved granularity. The addendum producing the increased photoefficiency is added to fully made and spectrally sensitized emulsions which simplifies the building of film layers containing multiple emulsions. Because of the empirical or "trial and error" method of selecting emulsions with the correct speed, the ability to alter the speed of an emulsion without having to remake and resensitize it provides a great savings in the cost of building a new photographic film. Furthermore, the addendum is inexpensive and readily available. It is one of the simplest of all organic chemicals leading one to expect few unwanted and unpredictable interactions with the many chemical components found in photographic film. These and other advantages will be apparent from the detailed description below.

The invention utilizes the addition of formate following the addition of silver ion to a previously spectrally sensitized emulsion of a type commonly employed in color negative applications.

Other approaches to this problem such as that described by Mydlarz et al in U.S. Pat. No. 5,849,470 use materials which slow the emulsion speed with the consequence of a loss of photoefficiency. Furthermore, these materials like those described by De Keyzer et al must be utilized prior to or during the sensitization process. In contrast, the present invention provides a means of altering photographic speed by increasing the photoefficiency of a sensitized emulsion fully prepared for use. By using lesser or greater amounts of the addenda, the speed of a fully sensitized emulsion can be tuned to the correct speed thereby providing a linear curve shape. This approach teaches away from that of De Keyzer et al in EP Application 0922994 A2 in which formate is utilized as a dopant and is added to the emulsion during its formation.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof. The silver halide emulsions may consist of chloride, bromide, and iodide and combinations thereof with the most useful emulsions consisting of silver bromoiodide since this combination generally produces the most efficient photographic emulsion.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Spectral sensitization is effected with one or more dyes, which are designed for the wavelength range of interest within the visible or infrared spectrum. It is known to add such dyes both before and after heat treatment.

Typical chemical sensitizations are performed with conventional middle chalcogen (i.e., sulfur, selenium, tellurium) sensitizers and/or noble metal sensitizers such as gold compounds. Reduction sensitizers, employed individually or in combination, are specifically contemplated.

A general summary of conventional approaches to chemical sensitizations can be found in *Research Disclosure*, Item 38957, Section III. Chemical Sensitization. Kofron et al in U.S. Pat. No. 4,439,520 illustrates the application of these sensitizations to tabular grain emulsions, as well as describing advantages for "dye in the finish" sensitizations, which are those that introduce the spectral sensitizing dye into the emulsion prior to the heating step (finish) that results in chemical sensitization. A more general summary of useful spectral sensitizing dyes is provided by *Research Disclosure*, December 1989, Item 38957, Section IV. Spectral sensitization and desensitization, A. Spectral sensitizing dyes.

Specific dopants, such as compounds of copper, thallium, lead, bismuth, cadmium and Group VIII nobel metals, can be present during process of the present invention or during preparation of silver halide grains employed in the emulsion layers of the photographic element. Other dopants include transition metal complexes as described in U.S. Pat. Nos. 4,981,781; 4,937,180; and 4,933,272.

The fully sensitized emulsion can then be treated with varying amounts of formate derived from any of a number of sources such as the sodium, potassium, ammonium, or other salts containing a suitable cation. It is contemplated that formic acid could be utilized followed by neutralization with an appropriate base such as sodium, potassium, or ammonium hydroxide. Treatment of the sensitized emulsion is accomplished under conditions where the formate is added to the surface of the emulsion. This can be done by treating the stirred emulsion with silver ion from any suitable source such as a silver nitrate solution, adding the formate, and treating the emulsion with a suitable bromide source such as sodium bromide solution. Alternatively, the formate could be added before the silver ion. It is further anticipated that excess bromide could first be added followed by formate and then silver ion, but in any case formate must be present when silver halide is deposited on the emulsion grains. The process of surface treatment in the presence of formate could be conducted in several steps. However, the silver ion addition needs to be conducted within certain limits to avoid formation of metallic silver which would fog the emulsion. When silver ion is being added, the bromide concentration as measured by the pBr (-log[bromide concentration]) should not be greater than 10.5. A preferred operating range is a pBr of from 3.55 to 8.69.

The photographic emulsions may be incorporated into color negative or reversal photographic elements. The photographic element may also comprise a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 $\mu$m. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras. In the following Table, reference will be made to (1) *Research Disclosure*, December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND.

| Reference | Section | Subject Matter |
|---|---|---|
| 1 | I, II | Grain composition, |
| 2 | I, II, IX, X, XI, | morphology and preparation. |
| | XII, XIV, XV | Emulsion preparation |
| | I, II, III, IX | including hardeners, coating |

-continued

| Reference | Section | Subject Matter |
|---|---|---|
| 3 & 4 | A & B | aids, addenda, etc. |
| 1 | III, IV | Chemical sensitization and |
| 2 | III, IV | spectral sensitization/ |
| 3 & 4 | IV, V | desensitization |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |
| 1 | VII | Image-couplers and image- |
| 2 | VII | modifying couplers; Wash-out |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum, as well as the electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing to remove silver or silver halide, washing, and drying.

The following examples illustrate the practice of this invention. They are not intended to be exhaustive of all possible variations of the invention. Parts and percentages are by weight unless otherwise indicated.

After spectral and chemical sensitization, the emulsion is coated on a support. Various coating techniques include dip coating, air knife coating, curtain coating, and extrusion coating.

The following examples illustrate the practice of this invention. They are not intended to be exhaustive of all possible variations of the invention. Parts and percentages are by weight unless otherwise indicated.

EXAMPLES

Emulsion Preparation

The emulsion is a tabular, dump iodide, bromoiodide type in which all of the iodide was added abruptly at about 68% of the make by dumping into the reaction vessel a silver iodide seed emulsion and then performing a silver over-run. A 0.84 M silver nitrate solution was added at the rate of 350 mL/min for 7.5 min into a reaction vessel with good stirring and containing 184 g of oxidized, lime-processed, bone gelatin, 322 g sodium bromide, and antifoamant in 46 L of distilled water maintained at 40° C. Following nucleation, an ammonia digest was performed with 4.5 moles of ammonia at pH 10 for 1 min. An additional 2220 g of oxidized, lime-processed, bone gelatin together with 114 g of sodium bromide and additional antifoamant in 30 L of distilled water was added and the pH was adjusted to 5.8. Growth was initiated by the addition of 0.84 M silver nitrate along with an equilmolar amount of sodium bromide solution in a double-jet mode maintaining a pBr of 1.71. The silver nitrate flow rate began at 73 mL/min and was increased to 262 mL/min over a period of 15 min. The silver nitrate solution was then changed to 3.0 M and growth was continued for 46 min ramping the flow from 73 to 1533 mL/min. 128 $\mu$g $K_4Ru(CN)_6$ was added to the reaction vessel during the last minute of growth. Flow was stopped while 4 L of 3.7 M sodium bromide was added, followed by 24.9 mg of KSeCN and 5.65 mol of silver iodide seeds. A silver over-run was performed by adding 3.0 M silver nitrate at the rate of 400 mL/min for 28.2 min. A balancing flow of sodium bromide was used to limit the drop in bromide concentration to a pBr of 2.70. Excess salt was removed by ultrafiltration to yield 125.5 moles of emulsion containing an average of 4.5% iodide with a grain size of 0.78×0.099 $\mu$m and a surface area of 550 $m^2$/mole.

Sample Preparation

Sample 1 (Comparison)

The emulsion was treated sequentially with antifoggant, AF-1; sodium thiocyanate; finish modifier, FM; yellow spectral sensitizing dyes, SD-1 and SD-2, in the molar ratio of 1 to 3; sulfur sensitizer, SS-1; gold sensitizer, GS-1; then was heated to 55° C. for 20 min, cooled to 40° C., and antifoggant AF-2 was added. The final pBr measured at 40° C. was 3.38.

Sample 2 (Comparison)

To Sample 1 which was melted and stirred at 40° C. was added 1000 mg/Ag mole of sodium oxalate. The mixture was stirred an additional 5 min then diluted with distilled water and prepared for coating.

Sample 3 (Comparison)

To Sample 1 which was melted and stirred at 40° C. was added 1000 mg/Ag mole of sodium formate. The mixture was stirred an additional 5 min then diluted with distilled water and prepared for coating.

Sample 4 (Comparison)

The pBr of Sample 1 which was melted and stirred at 40° C. was adjusted to 6.97 with silver nitrate. The mixture was stirred an additional 5 min then returned to the starting pBr by the addition of sodium bromide. This procedure deposited 6.98 $\mu$mol/$m^2$ silver bromide on the surface of the emulsion. Finally, the mixture was diluted with distilled water and prepared for coating.

Sample 5 (Comparison)

This Sample was treated the same as Sample 4 except 100 mg/Ag mole of sodium oxalate (1.36 $\mu$mol/$m^2$ of emulsion surface) was added immediately following the treatment with silver nitrate.

Sample 6 (Comparison)

This Sample was treated the same as Sample 4 except 1000 mg/Ag mole of sodium oxalate (13.6 $\mu$mol/m$^2$ of emulsion surface) was added immediately following the treatment with silver nitrate.

Sample 7 (Comparison)

This Sample was treated the same as Sample 4 except 100 mg/Ag mole of sodium formate (2.68 $\mu$mol/m$^2$ of emulsion surface) was added immediately following the treatment with silver nitrate.

Sample 8 (Invention)

This Sample was treated the same as Sample 4 except 1000 mg/Ag mole of sodium formate (26.8 $\mu$mol/m$^2$ of emulsion surface) was added immediately following the treatment with silver nitrate.

Sample 9 (Comparison)

This Sample was treated the same as Sample 4 except the pBr was adjusted to 8.68. This procedure deposited 10.5 $\mu$mol/m$^2$ silver bromide on the surface of the emulsion.

Sample 10 (Comparison)

This Sample was treated the same as Sample 9 except 100 mg/Ag mole of sodium oxalate (1.36 $\mu$mol/m$^2$ of emulsion surface) was added immediately following the treatment with silver nitrate.

Sample 11 (Comparison)

This Sample was treated the same as Sample 9 except 1000 mg/Ag mole of sodium oxalate (13.6 $\mu$mol/m$^2$ of emulsion surface) was added immediately following the treatment with silver nitrate.

Sample 12 (Invention)

This Sample was treated the same as Sample 9 except 100 mg/Ag mole of sodium formate (2.68 $\mu$mol/m$^2$ of emulsion surface) was added immediately following the treatment with silver nitrate.

Sample 13 (Comparison)

This Sample was treated the same as Sample 9 except 1000 mg/Ag mole of sodium formate (26.8 $\mu$mol/m$^2$ of emulsion surface) was added immediately following the treatment with silver nitrate.

Chemical Structures

AF-1

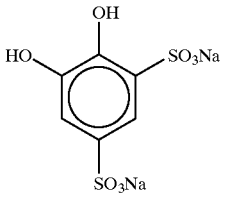

FM

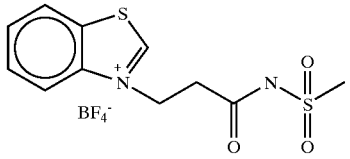

SD-1

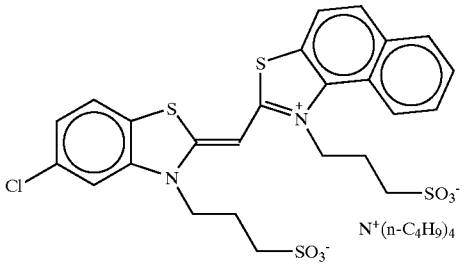

SD-2

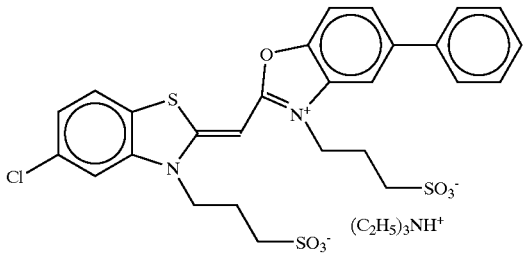

-continued

SS-1

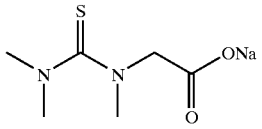

GS-1

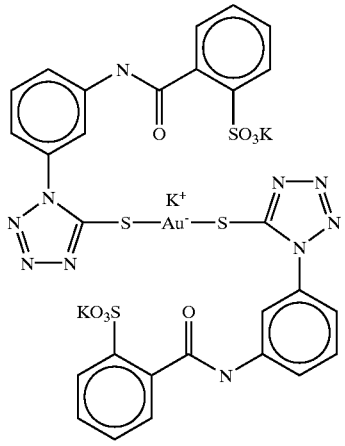

AF-2

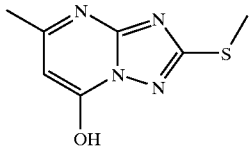

AF-3

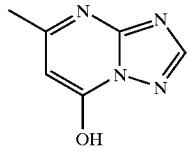

C-1

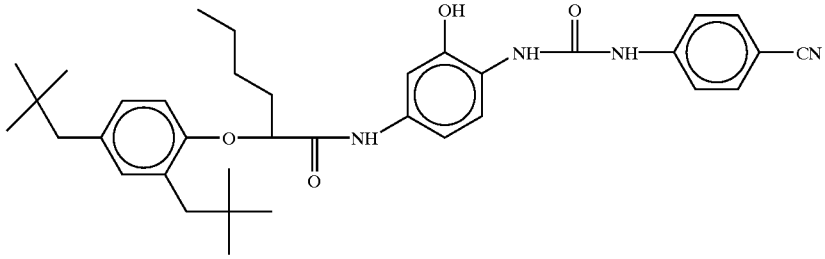

Photographic Evaluation

The sensitized emulsion samples were coated in a simple single layer format which consisted of a pad of gelatin on a cellulose acetate film support with an antihalation backing covered by a layer containing the emulsion and the image forming coupler, C-1. The emulsion layer was protected from abrasion by a gelatin overcoat containing hardener. A detailed description of the layered structure is described in following table.

Single Layer Format

| Coated Layer | Composition |
|---|---|
| Protective Overcoat | 2.69 g/m$^2$ gelatin |
| Emulsion/Coupler | 3.23 g/m$^2$ gelatin<br>0.81 g/m$^2$ Ag<br>0.007 g/m$^2$ antifoggant AF-3<br>1.61 g/m$^2$ coupler C-1 |

-continued

Single Layer Format

| Coated Layer | Composition |
|---|---|
| Gelatin Pad | 4.89 g/m$^2$ gelatin |
| Support | Cellulose Acetate |

Accelerated keeping studies were performed by holding film strips at 100° C. and 50% RH for 1 week. Raw stock performance was measured by exposing the strip after incubation and processing immediately. Latent image performance was measured by first exposing the strip and then incubating. In each case the performance of the incubated strip was referenced against a strip held at 0° C. and 50% RH.

Example 1

This example illustrates that oxalate and formate are ineffective when used to treat the emulsion at a relatively low pBr.

TABLE 1

| Sample | pBr | Oxalate (mg/mol) | Formate (mg/mol) | Fresh Response D-min | Speed | delta D-min | delta Speed |
|---|---|---|---|---|---|---|---|
| 1 Comparison | 3.38 | 0 | 0 | 0.055 | 235 | NA | NA |
| 2 Comparison | 3.38 | 1000 | 0 | 0.054 | 238 | −0.001 | 3 |
| 3 Comparison | 3.38 | 0 | 1000 | 0.057 | 239 | 0.002 | 4 |

D-min is the minimum optical density measured in an unexposed region of the film. Speeds were measured as 100(1-logH) where H is the exposure in lux-sec necessary to produce a density 0.15 above D-min.

Example 2

This example illustrates that at a moderately high pBr, formate can be effective at increasing photographic speed with very little effect on D-min. Note that at this pBr a high concentration of formate is required to get the speed effect. Also, even at the high concentration of oxalate, essentially no effect on speed is observed.

TABLE 2

| Sample | pBr | Oxalate (mg/mol) | Formate (mg/mol) | Fresh Response D-min | Speed | delta D-min | delta Speed |
|---|---|---|---|---|---|---|---|
| 4 Comparison | 6.97 | 0 | 0 | 0.098 | 239 | 0.043 | 4 |
| 5 Comparison | 6.97 | 100 | 0 | 0.057 | 237 | −0.041 | −2 |
| 6 Comparison | 6.97 | 1000 | 0 | 0.054 | 237 | −0.044 | −2 |
| 7 Comparison | 6.97 | 0 | 100 | 0.058 | 239 | −0.040 | 0 |
| 8 Invention | 6.97 | 0 | 1000 | 0.064 | 266 | −0.034 | 27 |

Note that Sample 4 is referenced against Sample 1 for calculating delta values while the other Samples in the table are referenced against Sample 4.

Example 3

This example illustrates that formate but not oxalate is very effective when used to treat the emulsion following a larger pBr adjustment. Note that at this pBr a low concentration of formate is effective while a high concentration causes excessive fog. Oxalate continues to be ineffective.

TABLE 3

| Sample | pBr | Oxalate (mg/mol) | Formate (mg/mol) | Fresh Response D-min | Speed | delta D-min | delta Speed |
|---|---|---|---|---|---|---|---|
| 9 Comparison | 8.68 | 0 | 0 | 0.065 | 244 | 0.010 | 9 |
| 10 Comparison | 8.68 | 100 | 0 | 0.065 | 243 | 0.000 | −1 |
| 11 Comparison | 8.68 | 1000 | 0 | 0.084 | 244 | 0.019 | 0 |
| 12 Invention | 8.68 | 0 | 100 | 0.106 | 274 | 0.041 | 30 |
| 13 Comparison | 8.68 | 0 | 1000 | 0.554 | 282 | 0.489 | 38 |

Note that Sample 9 is referenced against Sample 1 for calculating delta values while the other Samples in the table are referenced against Sample 9.

From the above examples, it is clear that formate provides a unique opportunity for the improvement of emulsion efficiency when used under a prescribed set of conditions.

Example 4

In this example we tabulate the response of various samples incubated under accelerated keeping conditions to further illustrate the utility of the invention. Sample 8 removed the latent image speed loss seen for the control, Sample 1, while Sample 12 brought both the raw stock and the latent image speed changes to nearly zero. Thus, formate not only can provide fresh speed increases but can also offer keeping benefits as well.

TABLE 4

| | | | Incubated Response | | | |
|---|---|---|---|---|---|---|
| | | | Raw Stock | | Latent Image | |
| Sample | pBr | Formate (mg/mol) | delta D-min | delta Speed | delta D-min | delta Speed |
| 1 Comparison | 3.38 | 0 | 0.068 | 26 | 0.061 | −41 |
| 7 Comparison | 6.97 | 100 | 0.056 | 19 | 0.048 | −8 |
| 8 Invention | 6.97 | 1000 | 0.122 | 29 | 0.15 | 2 |
| 12 Invention | 8.68 | 100 | 0.079 | −2 | 0.072 | −4 |
| 13 Comparison | 8.68 | 1000 | 0.332 | −34 | 0.278 | −13 |

The invention has been described in detail with particular reference to certain preferred embodiments thereof, but it will be understood that variations and modifications can be effected within the spirit and scope of the invention.

What is claimed is:

1. An emulsion comprising chemically and spectrally sensitized silver halide grains having formate on the surface of said grains, wherein said formate is added to the fully sensitized emulsion comprised of said chemically and spectrally sensitized silver halide grains.

2. The emulsion of claim 1 wherein silver halide comprises silver bromoiodide.

3. The emulsion of claim 1 wherein sodium formate is present in an amount of between 1 and 50 $\mu$mol/m$^2$ on the surface of said grains.

4. The emulsion of claim 3 wherein said grain further comprises additional silver bromide on the surface with said sodium formate.

5. The emulsion of claim 1 wherein the grains are chemically sensitized with sulfur and gold.

6. The emulsion of claim 5 wherein said grains are spectrally sensitized with blue dye.

7. The emulsion of claim 4 wherein additional silver bromide is present on the surface in an amount of between 1 and 100 $\mu$mol/m$^2$.

8. The emulsion of claim 1 wherein said formate comprises sodium formate.

9. A method of forming silver halide emulsion comprising providing an emulsion with silver halide grains, treating to finish said grains by chemically and spectrally sensitizing said grains, recovering an emulsion of finished grains, in order applying silver nitrate to the emulsion of finished grains, applying formate to said emulsion, and applying bromide to said emulsion.

10. The method of claim 9 wherein said formate comprises sodium formate.

11. The method of claim 9 wherein said bromide comprises potassium or sodium bromide.

12. The method of claim 9 wherein said silver halide grains comprise silver bromoiodide.

13. The bromoiodide of claim 9 wherein said formate comprises sodium formate.

14. The method of claim 11 wherein sodium formate is present in an amount of between 1 and 50 $\mu$mol/m$^2$ on the surface of said grains.

15. The method of claim 9 wherein silver bromide is applied to the surface in an amount of between 1 and 100 $\mu$mol/m$^2$.

16. The method of claim 9 wherein said applying silver nitrate to said emulsion of finished grains is in an amount of between 1 and 100 $\mu$mol/m$^2$.

17. The method of claim 9 wherein said finishing utilizes gold and sulfur chemical sensitizers.

* * * * *